US006232757B1

(12) United States Patent
Afghahi et al.

(10) Patent No.: US 6,232,757 B1
(45) **Date of Patent: *May 15, 2001**

(54) METHOD FOR VOLTAGE REGULATION WITH SUPPLY NOISE REJECTION

(75) Inventors: Morteza Afghahi, Tempe; Yueming He, Chandler, both of AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/635,296

(22) Filed: Aug. 10, 2000

Related U.S. Application Data

(62) Division of application No. 09/378,626, filed on Aug. 20, 1999, now Pat. No. 6,144,195.

(51) Int. Cl.[7] ..... G05F 3/16
(52) U.S. Cl. ..... 323/314; 323/280; 323/316
(58) Field of Search ..... 323/314, 280, 323/313, 316

(56) References Cited

U.S. PATENT DOCUMENTS 4,954,769 * 9/1990 Kalthoff ..... 323/313
5,061,862 * 10/1991 Tamagawa ..... 323/312

* cited by examiner

*Primary Examiner*—Shawn Riley
(74) *Attorney, Agent, or Firm*—Blakely, Sokoloff, Taylor & Zafman LLP

(57) ABSTRACT

An embodiment of the invention is directed to a voltage regulator that provides a conditioned reference voltage with high supply noise rejection. A reference circuit provides an input reference voltage. An operational amplifier (opamp) has a first opamp input coupled to the reference circuit, a second opamp input, and an opamp output to provide the conditioned reference voltage based on the input reference voltage. A differential MOS amplifier has a first input coupled to the opamp output and an output coupled to the second opamp input. The reference voltage is conditioned in accordance with the size of transistors in the differential amplifier. The voltage regulator may be used in different types of analog-to-digital converters, including those built for use with camera chips.

4 Claims, 7 Drawing Sheets

METHOD FOR VOLTAGE REGULATION WITH SUPPLY NOISE REJECTION

This application is a division of U.S. application Ser. No. 09/378,626, filed Aug. 20, 1999, now U.S. Pat. No. 6,144, 195.

FIELD OF THE INVENTION

This invention is related to techniques for providing a regulated output voltage while rejecting supply noise in circuits manufactured by a metal oxide semiconductor (MOS) process.

BACKGROUND

Voltage regulators provide a fixed output voltage regardless of a certain amount of variation in a supply voltage. They may be used to yield more robust electronic systems that include digital circuits, such as microprocessors, as well as mixed signal analog/digital circuits.

A conventional voltage regulator is shown in FIG. 8. A reference circuit (not shown) provides a bandgap reference voltage Vin which is temperature compensated and fixed at 1.25V regardless of fluctuations in the supply voltage Vdd. The reference voltage Vin is then amplified to a higher voltage at node ND12, and then buffered by a second stage including operational amplifier (opamp) 812, drive transistor M28, and load transistor M32, to provide greater drive capability at the output node ND14. This conventional design, however, suffers in several areas, particularly when implemented in a MOS process. First, to achieve low power consumption, the R1–R2 resistor network used to obtain voltage gain in the first stage having opamp 808 requires large value resistors in the range of hundreds of thousands of Ohms. Such large value resistors, however, consume a relatively large and valuable area on a MOS chip, particularly when implemented using polysilicon or source/drain diffusions. Although a "well" structure, formed in a substrate of an integrated circuit, for building the resistors consumes a smaller area than a polysilicon structure, for the same resistance value, the resistance obtained from the well structure is highly voltage dependent. Such voltage dependence precludes an accurate, regulated output voltage in a large number of mass produced chips, because the chips typically display manufacturing variations that cause significant voltage differences between them. Another drawback of the conventional well-based resistor design is its poor supply noise rejection. Using well structures for the R1–R2 resistor network in the first opamp stage allows noise in the substrate of the chip, where the substrate is at Vss, typically ground, to easily enter the signal path of the regulated output voltage, be amplified and appear in the output voltage.

SUMMARY

An embodiment of the invention is directed to a circuit that provides a conditioned reference voltage. A reference circuit provides an input reference voltage. An operational amplifier (opamp) has a first opamp input coupled to the reference circuit, a second opamp input, and an opamp output that provides the conditioned reference voltage based on the input reference voltage. A differential MOS amplifier has a first input coupled to the opamp output and an output coupled to the second opamp input. The reference voltage is conditioned in accordance with the size of transistors in the differential amplifier.

Other features and advantages of the invention will be apparent from the accompanying drawings and from the detailed description that follows below.

BRIEF DESCRIPTION OF THE DRAWINGS

The invention is illustrated by way of example and not by way of limitation in the figures of the accompanying drawings in which like references indicate similar elements and in which.

DETAILED DESCRIPTION

According to an embodiment of the invention, a differential MOS amplifier is used instead of the conventional resistor network in the negative feedback path of a closed loop amplifier in a voltage regulator. The use of a differential amplifier in such a configuration provides several advantages, namely smaller size as compared to well resistors, accurate determination of the gain used for conditioning the reference voltage by simple transistor sizing, and superior supply noise rejection. Promising simulation results are reported here for supply noise rejection and output rise time of the voltage regulator.

Figure 1:
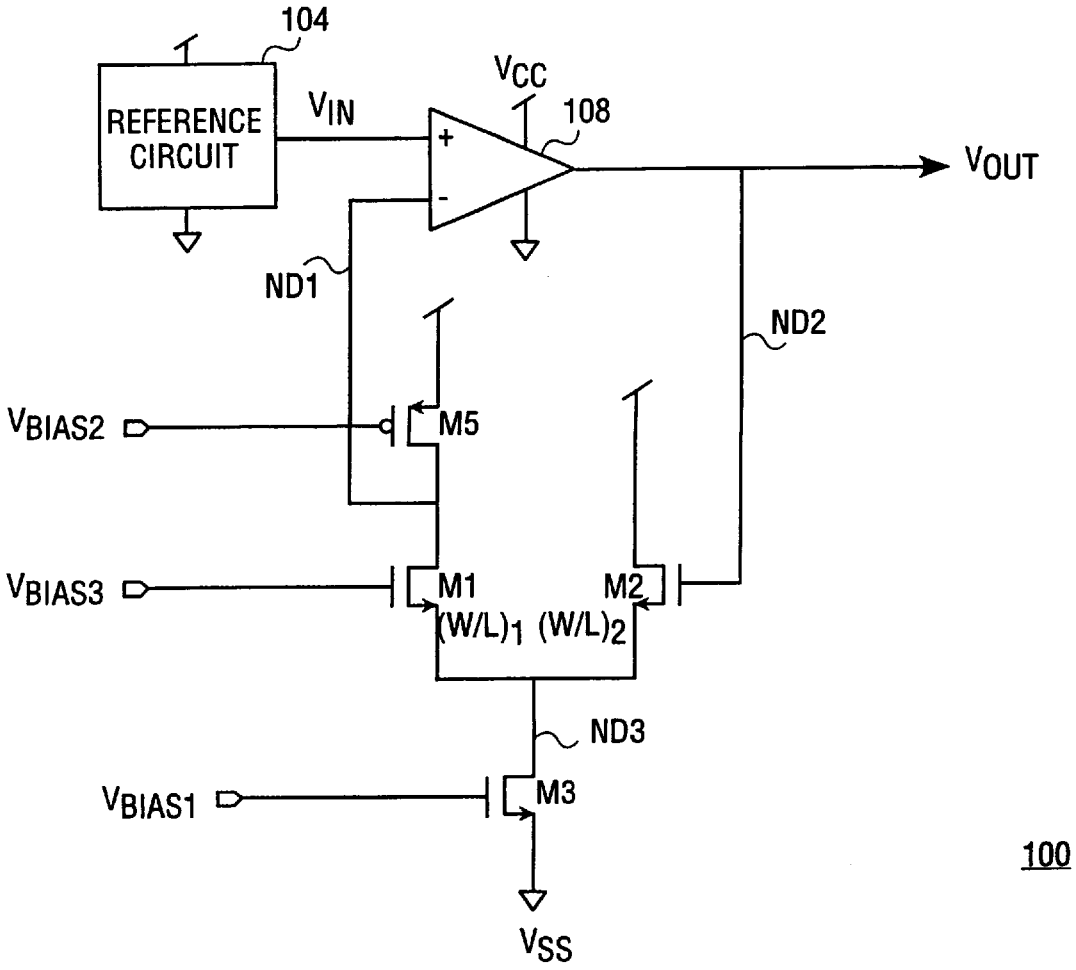
FIG. 1 shows a circuit schematic of an embodiment of the invention.

FIG. 1 illustrates a schematic of a voltage regulator 100 according to an embodiment of the invention. References to "an" embodiment are not necessarily to the same embodiment, and they mean at least one. The regulated output voltage Vout is a conditioned version of and based on the temperature compensated input reference voltage Vin provided by a reference circuit 104. Any conventional reference circuit may be used, including, for instance, a bandgap circuit. An operational amplifier 108 configured as part of a closed loop amplifier conditions the input reference voltage Vin. In this embodiment, the operational amplifier 108 is configured as a closed loop non-inverting amplifier with a voltage gain determined by the relative size of MOS field effect transistors (MOSFETs) M1 and M2 that constitute a differential amplifier. Transistors M1 and M2 are a differential pair each having dimensions, including a device width to length (W/L) ratio, that are selected, by one of ordinary skill in the art, to determine the gain or reduction that will be applied to Vin. These dimensions may be determined using a formula that gives Vout/Vin as a function of W/L for M1 and M2. Alternatively, a computer-aided simulation tool may be used to compute Vout/Vin for a range of W/L values in M1 and M2. Either scenario may be readily used by one of ordinary skill in the art to determine the particular dimensions of the transistors in the differential amplifier which will yield the desired conditioning of Vin.

The differential pair M1 and M2 has their source terminals shorted at node ND3. A bias transistor M3 provides a current path from node ND3 to supply ground Vss. A load transistor M5, in this case a P-channel device, is provided at the drain of M1. Although three different input bias signals, Vbias1, Vbias2, and Vbias3, are shown in the embodiment of FIG. 1 for properly biasing the respective transistors M3, M1, and M5, a single bias signal with an appropriate bias network may alternatively be provided to bias the entire differential amplifier. The output of the differential amplifier at node ND1 is single-ended and is coupled to the inverting input of the opamp 108. The inputs of the differential amplifier at the gates of M1 and M2 are connected to Vbias3 and to Vout, respectively.

As a closed loop amplifier, the voltage regulator 100 of FIG. 1, will, in the steady state, cause the voltage at node ND1 to be essentially equal to the input reference voltage Vin. This causes Vin to be conditioned into Vout, according to the relative dimensions of the differential MOS pair M1 and M2 which are connected in the negative feedback path of the closed loop amplifier that features opamp 108. The operation of the voltage regulator 100 may be explained as follows. Consider, for instance, that, for some reason, Vin becomes larger than the voltage at ND1. This in turn will cause the voltage at ND2 to rise. The gate source voltage Vgs2 for M2 will also increase. The latter event results in the drain source voltage Vds2 of M2 to drop assuming the same current continues to flow in M2. The drop in Vds2 will in turn increase the voltage at node ND3. The latter event will, of course, reduce the gate source voltage Vgs1 of M1, assuming that Vbias1 and Vbias3 remain independently fixed. Since the voltage at ND3 increased, the voltage at ND1 will increase until it is the same as Vin. On the other hand, if the voltage at ND1 were to rise too much, and thus become larger than Vin, then the reverse of the above operations would occur, thus lowering the voltage at ND1. This feedback control is sufficiently stable and fast as to maintain Vin and ND1 at approximately the same potential in the steady state. Thus, Vout/Vin, in the steady state, is essentially fixed by the relative sizes of M1 and M2.

Figure 2:
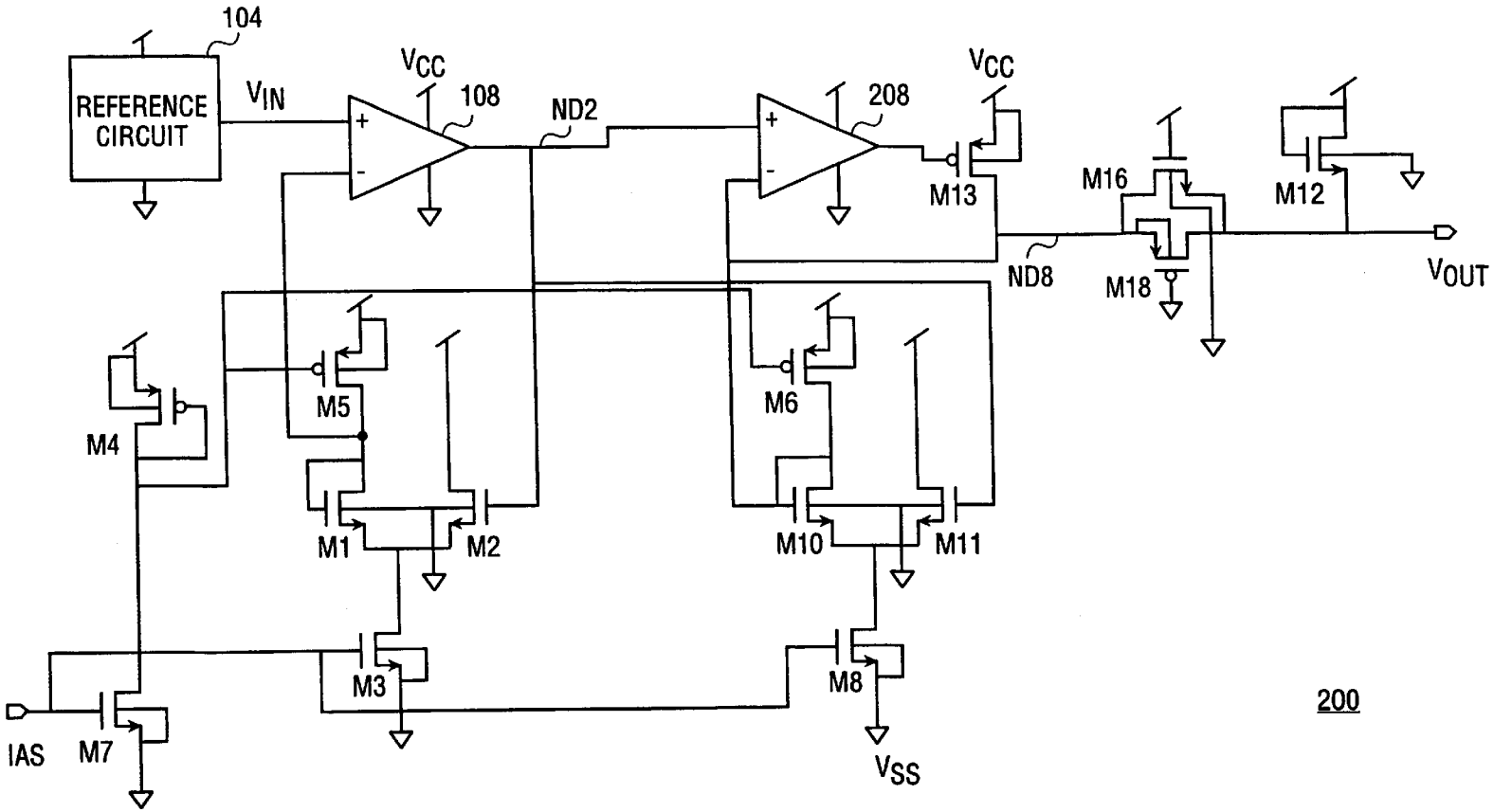
FIG. 2 illustrates a circuit schematic of a voltage regulator according to another embodiment of the invention.

Another embodiment of the invention is illustrated in FIG. 2 as a two-stage voltage regulator 200. The first stage includes opamp 108 and differential pair M1–M2 and operates the same as described above in connection with voltage regulator 100 of FIG. 1. The second stage is built around a second opamp 208 and drive transistor M13 which are configured as a unity gain amplifier to buffer the conditioned reference voltage at node ND2. A second differential amplifier comprising differential pair M10 and M11, bias device M8, and load device M6, which may be identical to the differential amplifier of the first stage, are configured as a load to the second stage. The second differential amplifier provides a path between node ND8 and power supply ground Vss with high supply noise rejection. The output of the second differential amplifier is single-ended and connected to the node ND8. The output drive transistor M13 is controlled by the output of the second opamp 208 for driving heavy loads and is optional. Similarly, the diode connected transistor M12 coupled between node ND8 and the positive supply is optional, although it helps reduce the rise time of Vout in the presence of heavy loads. Another optional item is the combination of transistors M16 and M18 configured as a resistor to provide the voltage regulator 200 a resistive output impedance. As mentioned above with respect to the embodiment of FIG. 1, the differential amplifiers may be biased using a bias network under the control of a single signal. In the embodiment of FIG. 2, the bias network includes transistors M7 and the combination current mirrors of transistors M4 and M5 and transistors M4 and M6. Alternatively, other types of bias networks may be used.

Figure 3:
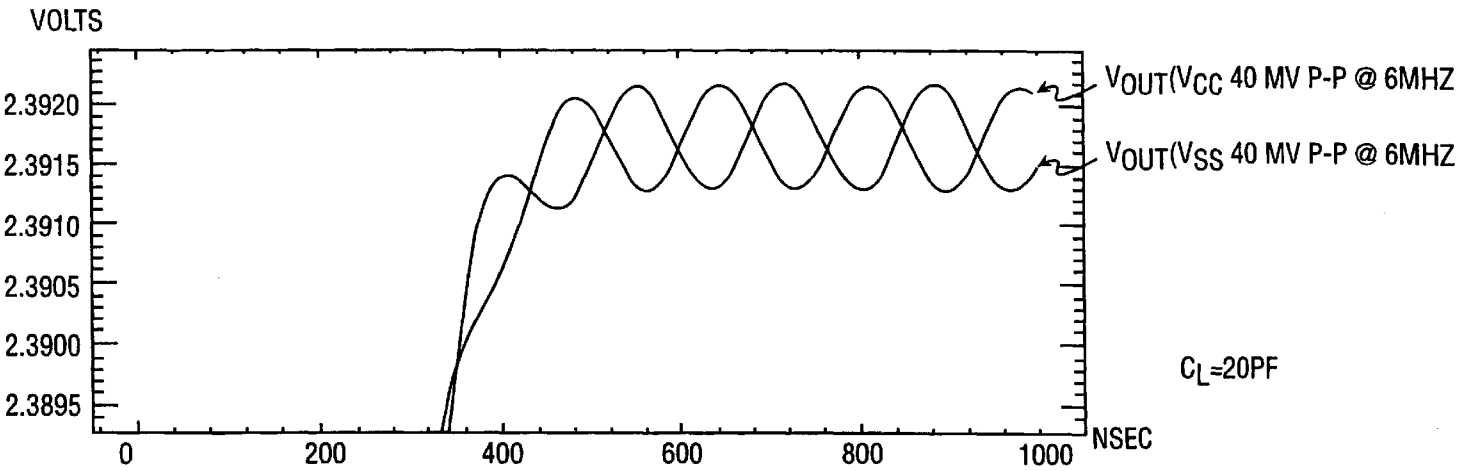
FIGS. 3–5 are plots of output voltage waveforms of a simulated voltage regulator configured according to an embodiment of the invention.
Figure 4:
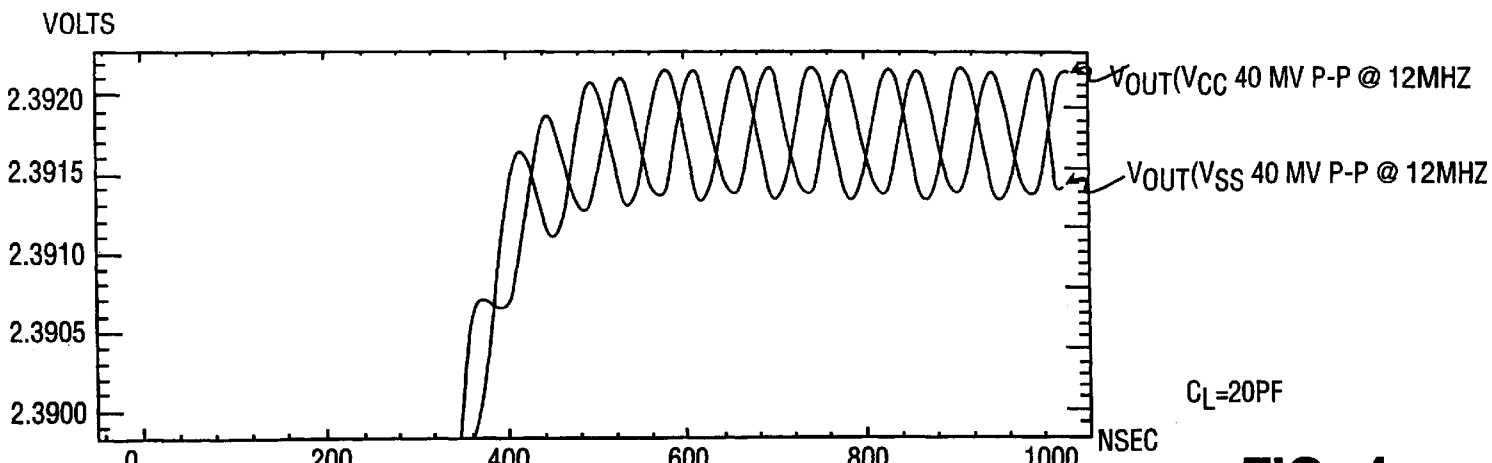
Figure 5:
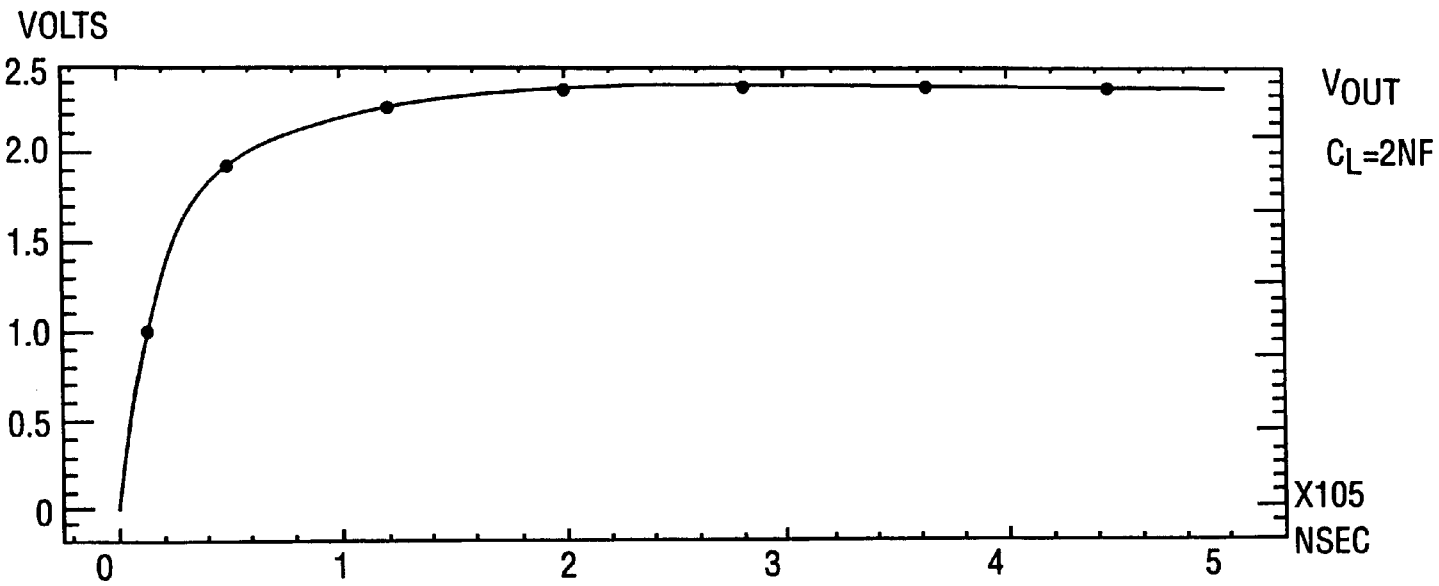

FIGS. 3–5 illustrate waveforms for Vout obtained by a computer simulation of the voltage regulator 200 designed for an output voltage of approximately 2.39 volts, based on an input reference voltage Vin of 1.24 volts and a load capacitator of 20 pF. These waveforms are merely exemplary, and the invention is not limited to such waveforms. FIG. 3 shows two waveforms for Vout. One was obtained by injecting a 40 mV peak to peak 6 MHz sinusoid into the positive supply Vcc, whereas the other was obtained while injecting the same sinusoid into the power supply ground Vss. The results show that less than one mV of noise is present in the output voltage Vout, signifying a 30 dB rejection of the supply noise. FIG. 4 shows a plot of simulated Vout in the presence of a noise sinusoid at 12 MHz. The resulting noise in Vout is only slightly greater than that observed at 6 MHz, for the same load capacitance. These two simulation results in FIGS. 3 and 4 show that the voltage regulator 200 exhibits high supply rejection over a relatively broad frequency range. It is believed that a primary factor that contributes to such a high supply rejection is the use of the differential pair M1 and M2 in the first stage, and M10 and M11 in the second stage.

FIG. 5 shows the simulated rise time of the output voltage Vout for the embodiment if FIG. 2 when driving a relatively large load capacitance of 2 nF. As was mentioned previously, a primary factor that is believed to contribute to this relatively fast rise time is the use of the pull up transistor M12 in the embodiment of FIG. 2.

Figure 6:
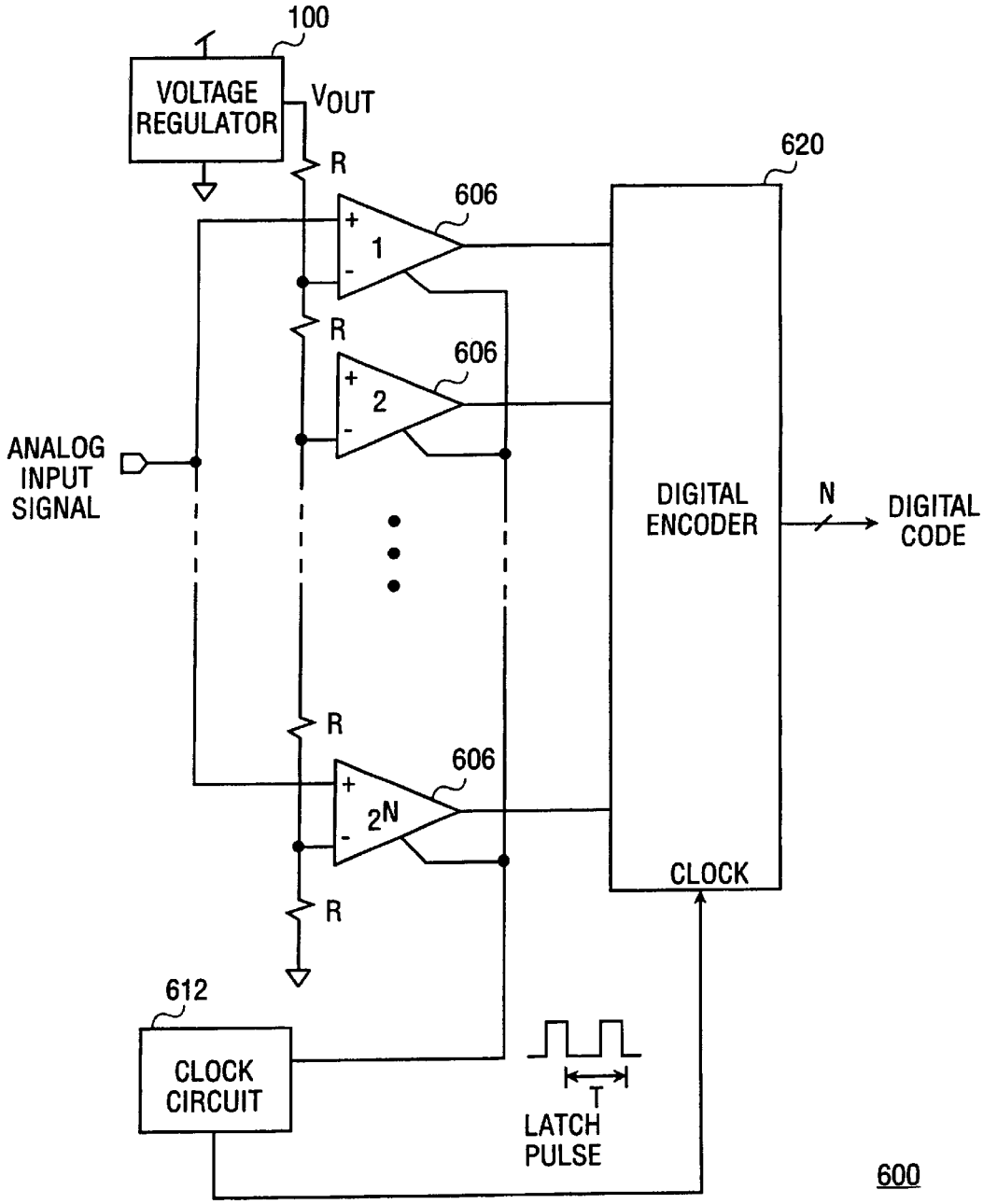
FIG. 6 depicts a block diagram of an analog to digital converter featuring a voltage regulator.

The voltage regulators 100 and 200 may be used in a variety of different circuit applications, including for instance clock recovery circuits, temperature sensors, and analog to digital (A/D) converters. FIG. 6 illustrates an exemplary application being a parallel analog to digital converter 600. This N bit converter includes a voltage regulator whose output Vout feeds a resistor ladder network. Each separate potential on the resistor ladder network is a unique voltage level which is connected to the inverting input of a respective sense amplifier 606. The non-inverting input of each sense amplifier 606 receives the analog input signal. A clock circuit 612 provides a periodic waveform which defines a series of latch pulses that are fed to each sense amplifier 606. The result of the comparison by each sense amplifier 606 is latched during the latch pulse T, and read by the digital encoder 620. The digital encoder 620 then translates the "thermometer" output from the sense amplifiers 606 into an N-bit digital code. The digital code is updated at the clock frequency of 1/T. Other A/D converter applications for the voltage regulator 100 or 200 include sigma-delta converters.

Figure 7:
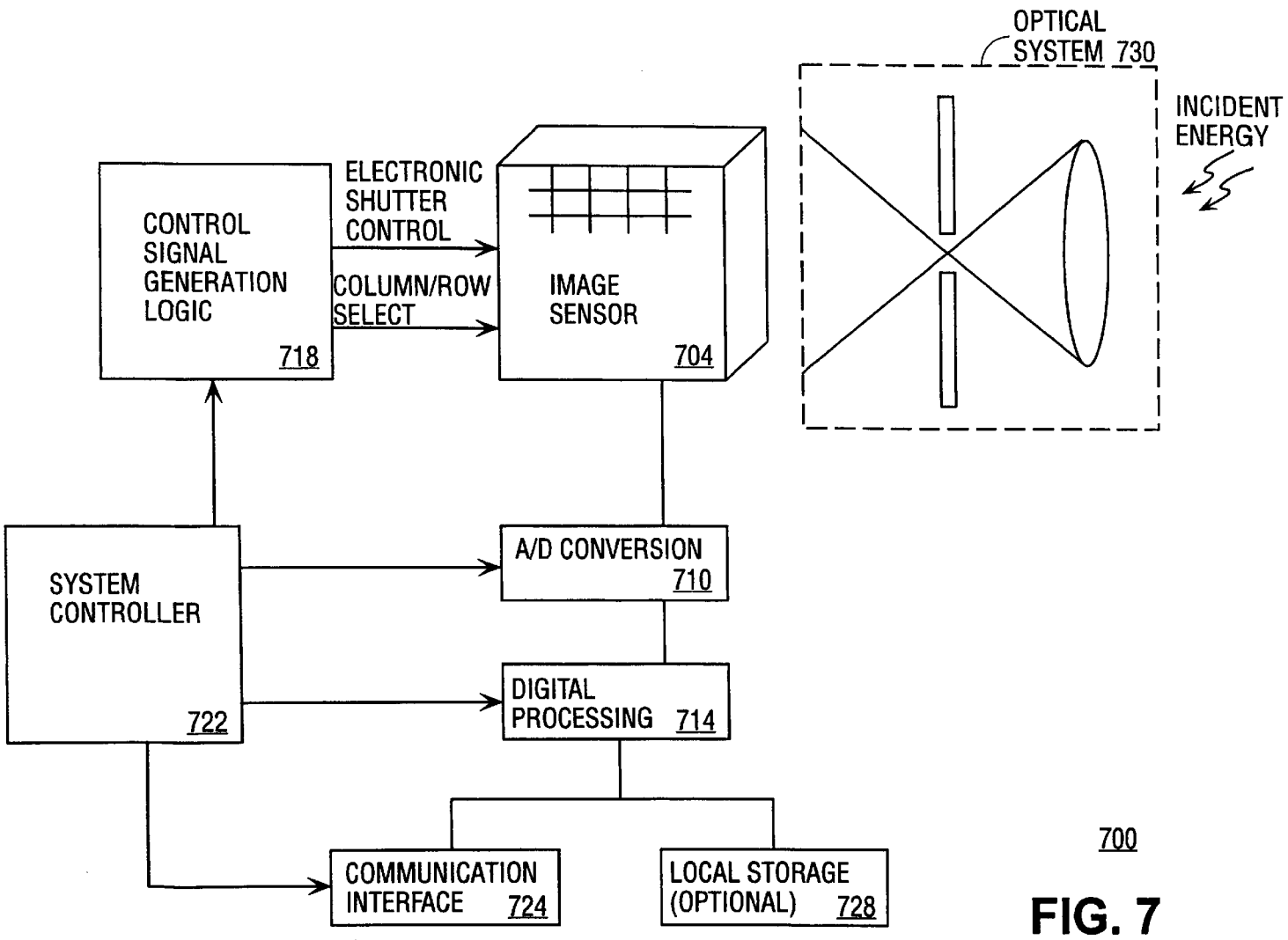
FIG. 7 illustrates a system application of the analog to digital converter according to an embodiment of the invention.
Figure 8:
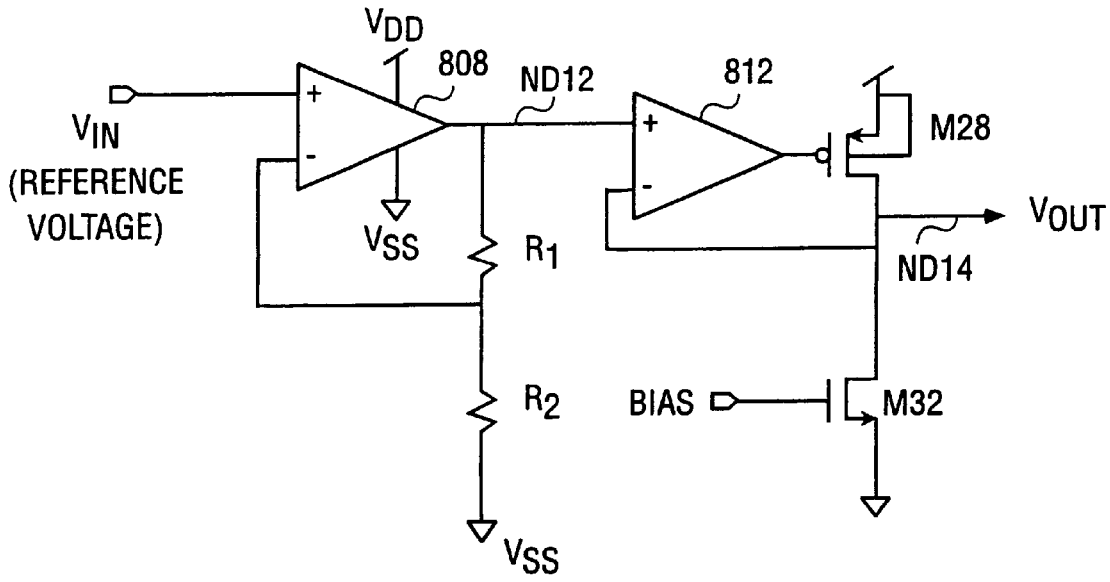
FIG. 8 (PRIOR ART)
FIG. 8 shows a conventional voltage regulator.

The A/D converter 600 and its alternatives described above may be used as part of a digital imaging system 700 shown in functional block diagram form in FIG. 7. The imaging system 700 has an optical system 730 that channels incident energy, being visible light in one case, to create an optical image on an image sensor chip 704. Control signal generation circuitry 718 is provided to generate electronic shutter control signals and row/column select lines needed to control the photocells of the image sensor. Sensor signals are then further processed by an A/D conversion unit 710 which digitizes the sensor signals and feeds a digital processing block 714. The A/D conversion unit 710 may include one or more of the A/D converters 600 to digitize the sensor signals received over each bitline of the image sensor 704. The bitlines may be multiplexed to a single A/D converter 600, or they may each have a dedicated respective A/D converter 600. The A/D unit 710 and portions of the digital processing block 714 may be located on the same die as the image sensor 714. The digital processing may be done by hardwired logic and/or a programmed processor that performs a variety of digital image processing functions, including perhaps preparing compressed digital image data based on the sensor signals for more efficient storage or transmission.

Transmission of the image data to an external processing system such as a stand alone personal computer may be accomplished using the communication interface 724. For instance, as a digital camera, the communication interface implements a computer peripheral bus standard such as universal serial bus (USB) or a high speed serial bus protocol. The imaging system 700 as a digital camera may also contain a local storage 728 of the non-volatile variety, for instance including a solid state memory such as a removable memory card, a rotating magnetic disk device, or other suitable memory device for permanent storage of digital image data. The operation of the system 700 may be orchestrated by a system controller 722 which may include a conventional microcontroller responding to instructions stored as firmware.

To summarize, various embodiments of the invention have been described that are directed to an improved voltage regulator, and particular applications of the voltage regulator, that is both compact and exhibits high supply rejection. In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A method comprising:

applying a reference voltage to a first opamp input of an operational amplifier;

applying a bias voltage to a first input of a differential MOS pair, the pair having a second input coupled to an output of the operational amplifier and an output coupled to a second opamp input of the operational amplifier so that the reference voltage is conditioned in accordance with the size of transistors in the differential pair.

2. The method of claim 1 wherein the first bias voltage is substantially fixed.

3. The method of claim 2 further comprising:

applying a second bias voltage to an input of a load transistor that is in series with a first transistor of said MOS pair.

4. The method of claim 3 further comprising applying a third bias voltage to set a sum current for the differential pair.

* * * * *